US005501508A

United States Patent [19]

Llewellyn

[11] Patent Number: 5,501,508

[45] Date of Patent: Mar. 26, 1996

[54] DEVICE FOR SUPPORTING THE USER OF A CHAIR

[76] Inventor: Anthony S. Llewellyn, 19355 Wells Rd., Athens, Ala. 35611

[21] Appl. No.: 296,502

[22] Filed: Aug. 26, 1994

[51] Int. Cl.[6] ..... A47C 7/36

[52] U.S. Cl. ..... 297/397; 297/284.5; 297/394; 297/227

[58] Field of Search ..... 297/284.3, 284.1, 297/284.5, 284.4, 397, 394, 395, 411.23, 452.48, 227

[56] References Cited

U.S. PATENT DOCUMENTS

| | | | |
|---|---|---|---|
| 1,579,585 | 4/1926 | Wieder et al. | 297/394 |
| 2,812,804 | 11/1937 | Sandor | 297/284.5 |
| 4,630,863 | 12/1986 | Roberts | 297/452.48 |
| 4,738,486 | 4/1988 | Surber | 297/DIG. 3 X |
| 4,773,707 | 9/1988 | Vadala | 297/391 |
| 4,862,536 | 9/1989 | Pruit | 297/284.5 |
| 5,015,036 | 5/1991 | Fergie | 297/397 |
| 5,054,854 | 10/1991 | Pruit | 297/284.4 |
| 5,211,696 | 5/1993 | Lacy | 297/397 |

*Primary Examiner*—Peter R. Brown
*Assistant Examiner*—Anthony D. Barfield
*Attorney, Agent, or Firm*—Waddey & Patterson; I. C. Waddey, Jr.

[57] ABSTRACT

A device which can be releasible attached to a seat preferably at the head rest. The device has a series of four cascading upper head support member attached to the attachment member by straps. These straps may be elastic and of different lengths to provide a cascading effect. One, two, or more, or any combination of the same can be used for a different height and thickness adjustments. Further joined to the attachment member is a lumbar support. Attached to the lumbar support is a back side support. Also joined to the attachment member is one or two arm rests that can extend adjacent to the base of the seat to provide support of the user's arms. Each of these straps may be elastic thereby allowing their length to be adjusted.

5 Claims, 3 Drawing Sheets

DEVICE FOR SUPPORTING THE USER OF A CHAIR

BACKGROUND OF THE INVENTION

The present invention relates generally to a device for supporting the user of a chair and more particularly to a device attachable to the seat of a motor vehicle for supporting the head, the lumbar, the back side and the arms of a user.

It would be appreciated by those skilled in the art that automobile seats are ergonomically designed to conform to the needs of the user of that seat. However, it will further be appreciated by those skilled in the art that individuals are of different sizes. Therefore, ergonomic engineering is of only limited benefit. Further, in order for a motor vehicle seat to include multiple supports, the price of the motor vehicle must increase. To this end, there have been several attempts to provide devices which attach to a seat to better conform to the body of the user.

U.S. Pat. No. 4,773,707 issued to Peter Vadala on Sep. 27, 1988 discloses a head rest attachment. Unfortunately, this device is merely a series of interlocking blocks which surrounds the head rest. It supports no other part of the body. Further, even for the head rest, it only allows one thickness.

Similarly, U.S. Pat. No. 5,015,036 issued to B. Fergie discloses an apparatus used as a head rest. It too only supports the head and neck of the user. Further, it is not adjustable in either height or thickness.

Also, U.S. Pat. No. 5,211,696 issued to J. Lacy on May 18, 1993 discloses a head rest that has all of the limitations of the other two patents. It does not provide vertical adjustment. Further, it fails to provide any kind of thickness adjustment.

What is needed, then, is a device that can be easily attached to a seat. This needed device must be capable of providing support to the head of the user. This needed device must be capable of providing support to the lumbar. This needed device must be capable of supporting the back side of the user. This needed device must be capable of supporting the arms of the user. Further, this needed device must be capable of providing vertical adjustment as well as thickness adjustment. This needed device must be capable of easy storage and shipping. This needed device is presently lacking in the prior art.

SUMMARY OF THE INVENTION

The present invention discloses a device which can be releasably attached to a seat preferably at the head rest. The device has a series of two or more cascading upper head support members (in the preferred embodiment, there are four such members) attached to the attachment member by straps. These straps may be made of elastic or strips of cloth and of different lengths to provide a cascading effect. One, two, or more, or any combination of the same can be used for a different height and thickness adjustments. Further joined to the first cushion is a lumbar support. Attached to the lumbar support is a back side support. Also joined to the attachment member is one or two arm rests that can extend adjacent to the base of the seat to provide support of the user's arms. Each of these straps may be elastic thereby allowing their length to be adjusted.

Accordingly, one object of the present invention is to provide a device which can be easily attached to an existing seat.

Still a further object of the invention is to provide a device that is easy to manufacture, ship, and store.

A still further object of the present invention is to provide a device which supports the head of the user.

A still further object of the present invention is to provide a device which supports the lumbar of the user.

A still further object of the present invention is to provide a device which supports the back side of the user.

A still further object of the present invention is to provide a device which supports the arms of the user.

Still another object of the present invention is to provide a device which allows vertical as well as horizontal adjustment.

A still further object of the invention is to provide a device which allows thickness adjustments.

DESCRIPTION OF THE PREFERRED EMBODIMENT

Figure 1:
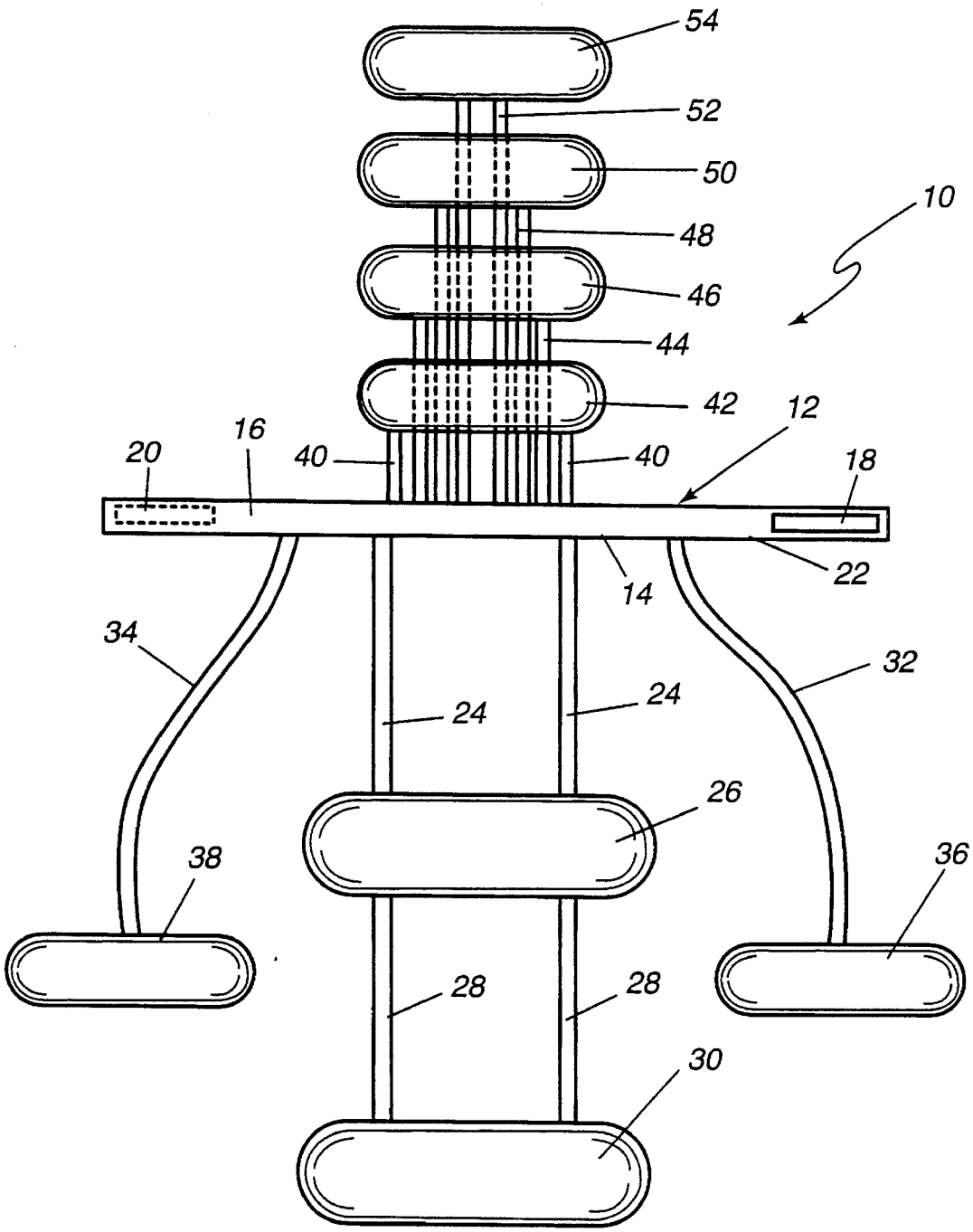
FIG. 1 is a plain view of the device of the present invention.

Referring now to FIG. 1, there is shown generally at 10 the device for supporting the user of a seat of the present invention. Device 10 has attachment member 12 which is, in the preferred embodiment, a wrap or a strip 14 having first end 20 and second end 22. Attached to first end 20 there is male mating engagement fabric 16 whereas attached to second end 22 there is female mating engagement fabric 18. Fabric 16, 18 is joined when attachment member 12 releasibly attaches to a chair or seat. Joined to attachment member 12 by lumbar strap 24 is lumbar support 26. Alternatively, the lumbar support 26 is connected by lumbar straps 24 to the back of first upper or head support 42 (see alternate connection of lumbar straps 24 illustrated by the dashed line 24' of FIG. 2). Joined to lumbar support 26 by lower strap 28, there is lower support 30. Also attached to attachment member 12 by respectively right arm strap 32 and left arm strap 34 are right arm rest 36 and left arm rest 38. Attached to attachment member 12 by first strap 40, there is first upper or head support 42. Also attached to attachment member 12 by second strap 44 is second upper or head support 46. Attached to attachment member 12 by third strap 48 is third upper or head support 50. Similarly, attached to attachment member 12 by fourth strap 52 is fourth upper or head support 54. In the preferred embodiment, straps 24, 28, 32, 34, 40, 44, 48, and 52 are attached to member 12 by means that enables their length to be adjusted. The attachment can be by the straps passing through connector eyelets and folded back onto themselves and attached by hook and loop fabric fasteners, by hook and loop fabric fasteners, one attached to the end of the strap and the other attached to the cushion/support member, or the straps can themselves by made of an elastic material to allow them to stretch slightly for adjustment. Further, in the preferred embodiment, strap 52 is longer than strap 48 which is longer than strap 44 which is longer than strap 40 which creams a cascading effect which will be described later.

In the preferred embodiment, supports 26, 30, 36, 38, 42, 46, 50, and 54 are cushions made of sufficiently soft but firm material. In the preferred embodiment, straps 24, 28, 32, 34, 40, 44, 48, and 52 are made of cloth strips. Further, in the preferred embodiment, supports 26, 30, 36, 38, 42, 46, 50, and 54 are made of polyfil with a polyester/cotton shell.

Figure 2:
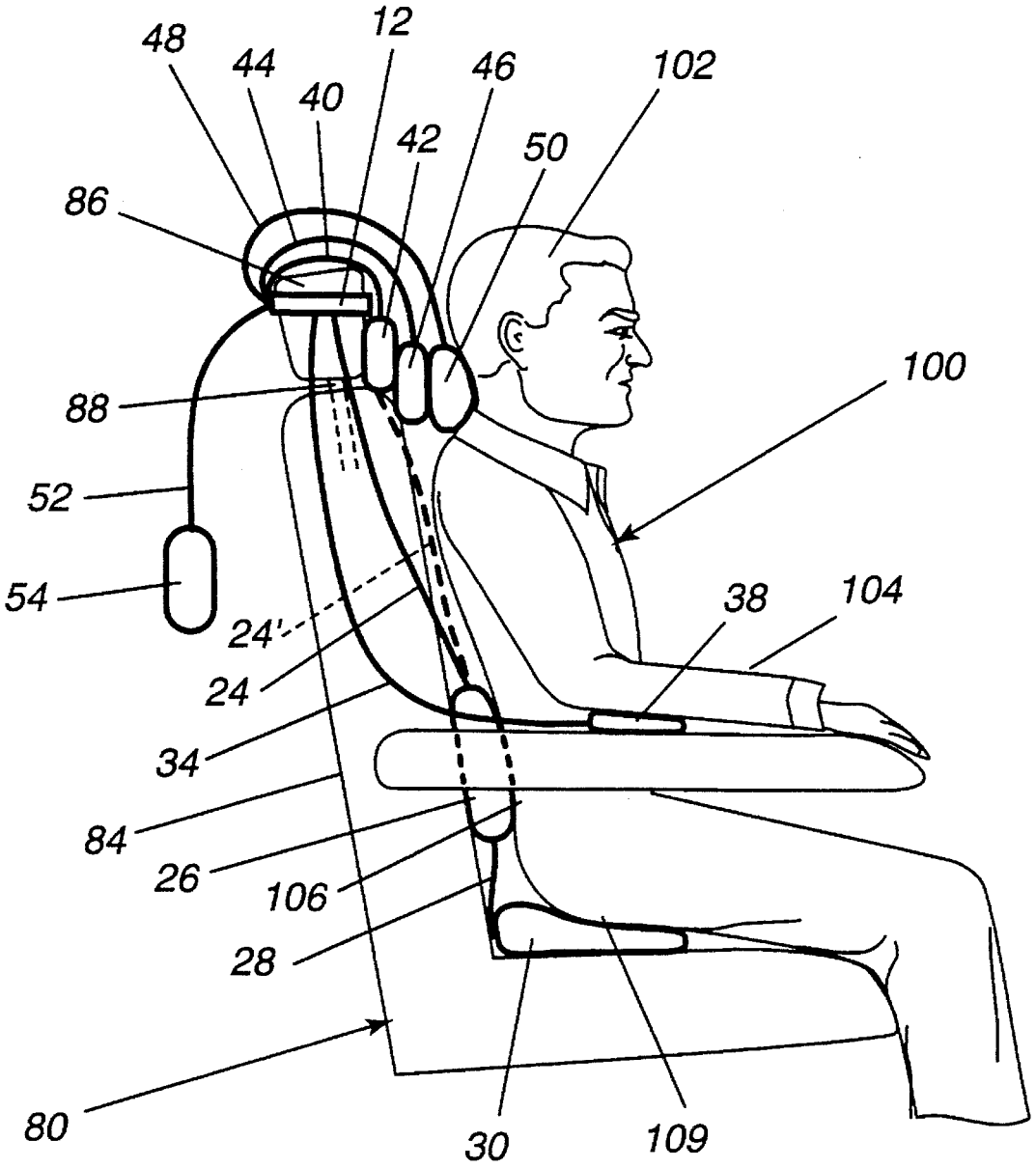
FIG. 2 is a side view of the device of the present invention as used in connection with a chair or a seat by a user.
Figure 3:
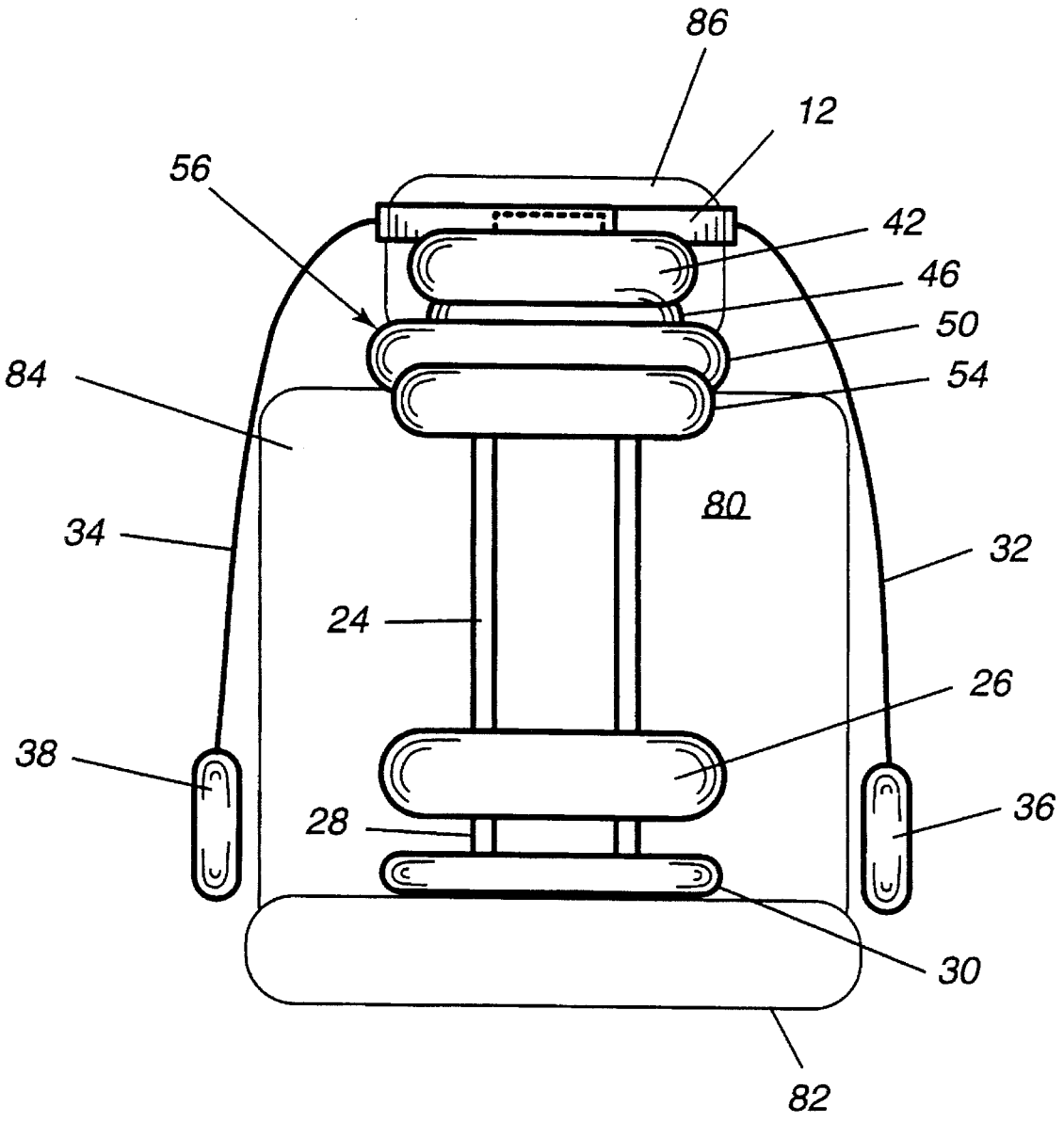
FIG. 3 is a frontal view of the device of the present invention as used in connection with a chair.

Referring now to FIGS. 2 and 3, one can see generally how device 10 works in connection with seat 80 and user 100. Seat 80 usually has base 82, and head rest 86 joined by back 84. In many cases, head rest 86 is adjustable by head rest bracket 88. Device 10 can be attached in the preferred embodiment to head rest 86, although device 10 can be attached to back 84. In the preferred embodiment, device 10 attaches to head rest 86 by attachment member 12 which encircles and releasible attaches to head rest 86. To support the head 102 of user 100, head support members such as 42, 46, 50, and 54 are provided. However, any number greater than one of such support members can be provided. In the preferred embodiment, support members 42, 46, 50, and 54 are attached to attachment member 12, with first upper or head support member 42 being attached by first strap 40, second upper head support 46 being attached by second strap 44,, third head or upper support member 50 attached by third strap 48 and fourth upper or head support member 54 being attached by fourth strap 52. Because strap 40 is shorter than strap 44 which is shorter than strap 48 which is shorter than strap 52, in the preferred embodiment, the support members can be arranged in a cascading effect as shown clearly in FIG. 3 and partially in FIG. 2. This allows user 100 to adjust both the horizontal thickness as well as the vertical height of total head support member 56. Additionally, attached either to attachment member 12 or to first upper head support 42 is lumbar support 26 by lumbar strap 24. Lumbar support 26 provides support to lumbar 106 of user 100. Attached to lumbar support 26 by lower strap 28 is lower support 30. In the preferred embodiment, strap 28 is elastic so that it can be stretched or contracted depending on where the user 100 needs to position it. Further, attached to attachment member 12, there is right arm rest 36 and left arm rest 38 by, respectively, right arm strap 32 and left arm strap 34. Straps 32, 34 may be elastic so that the position is adjustable.

In FIGS. 1–3, many of the straps are shown as narrow straps or as dual narrow straps. However, this is not intended as a limitation as elastic cords, wider straps or any other such attachment member can be used.

Although in the preferred embodiment, device 10 is intended for use with a motor vehicle seat 80, the cushion can be used on any kind of seats such as recliner, chair, office chair or any other.

Thus, although there have been described particular embodiments of the present invention of a new and useful "Device for Supporting the User of a Seat", it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A device for use in connection with a seat having a base, a back, and a headrest, said device comprising:

a. an attachment member having means for releasible attaching said device to said headrest;

b. a first upper support member attached to said attachment member by a first elongated strap extending between said attachment member and said first upper support member;

c. at least one additional upper support member attached to said attachment member by at least one additional strap, at least one strap for each additional upper support member, with each succeeding additional strap being longer than the preceding strap said at least one additional strap and respective additional support member being separate from and unattached to any other preceding support member; and d. a lumbar support member attached to said first attachment member by a lumbar strap said lumber support member adapted to extend to a lumbar point on said back.

2. The device of claim 1 further including a right armrest and a left armrest each attached to said attachment member by an armrest strap adapted to extend to an armrest point adjacent to said base.

3. The device of claim 2 further including a lower cushion attached to said lumbar support member by a lower strap adapted to extend to said base.

4. The device of claim 1 further including a lower cushion attached to said lumbar support member by a lower strap adapted to extend to said base.

5. The device of claim 1 further including means enabling the length of one or more of the straps to be adjusted.

* * * * *